US006523317B1

(12) United States Patent
Bott et al.

(10) Patent No.: US 6,523,317 B1
(45) Date of Patent: Feb. 25, 2003

(54) WALL BLOCK WITH INTERLOCK

(75) Inventors: Timothy A. Bott, Sunfish Lake, MN (US); Robert A. Gravier, Bloomington, MN (US)

(73) Assignee: Allan Block Corporation, Edina, MN (US)

( * ) Notice: Subject to any disclaimer, the term of this patent is extended or adjusted under 35 U.S.C. 154(b) by 40 days.

(21) Appl. No.: 09/944,644

(22) Filed: Aug. 31, 2001

(51) Int. Cl.[7] ..... E04B 5/04; E04C 2/04

(52) U.S. Cl. ..... 52/609; 52/604; 52/605; 52/612; 52/590.2; 52/590.3; 52/591.1; 52/592.1; 52/592.5; 52/592.6; 405/286; 405/262; 256/19

(58) Field of Search ..... 52/600, 602, 604, 52/605, 606, 608, 609, 270, 271, 284, 286, 589.1, 590.2, 590.3, 591.1, 592.3, 591.4, 592.4–592.6, 421, 431, 612; 405/284, 286, 258.1, 262; 256/19

(56) References Cited

U.S. PATENT DOCUMENTS 4,802,320 A * 2/1989 Forsberg ..... 52/585
5,161,918 A * 11/1992 Hodel ..... 405/286
5,484,236 A * 1/1996 Gravier ..... 405/286
5,490,363 A * 2/1996 Woolford ..... 52/604
5,505,034 A * 4/1996 Dueck ..... 52/604
5,622,456 A * 4/1997 Risi et al. ..... 405/284
5,623,797 A * 4/1997 Gravier et al. ..... 52/284
5,653,558 A * 8/1997 Price ..... 405/284
5,941,042 A * 8/1999 Dueck ..... 52/604
5,951,210 A * 9/1999 Maguire et al. ..... 405/286
6,082,067 A * 7/2000 Bott ..... 52/592.3

* cited by examiner

*Primary Examiner*—Yvonne M. Horton
(74) *Attorney, Agent, or Firm*—Haugen Law Firm PLLP

(57) ABSTRACT

A wall block arranged to be stacked vertically for creation of a retaining wall, the block being of generally trapezoidal configuration having parallelly arranged front and rear surfaces along with opposed top and bottom surfaces. The top surface has front and rear lips formed thereon with each of the lips having a trapezoidal root portion with mutually opposed triangular portions converging inwardly therefrom to define opposed and aligned front and rear apices. In one embodiment, the apices are disposed midway along the length of the block, while in a second embodiment, the apices are formed at the juncture point of mated pairs of blocks. The bottom surface of the block includes a central base with opposed notches formed along the front and rear edges of the bottom surface, with the base having a trapezoidal configuration with a width dimension which is no greater than the spacing between the opposed aligned front and rear apices.

4 Claims, 6 Drawing Sheets

WALL BLOCK WITH INTERLOCK

BACKGROUND OF THE INVENTION

The present invention relates generally to an improved stable structural wall block, and more particularly to an improved block which is arranged to be stacked vertically for creation of a structure wall such as in a building structure, a fence, or as a retaining wall of straight, curved and/or serpentine configuration. A non-protruding interlock is formed on the block surfaces for inter-engagement between individual vertically stacked blocks with the interlock assisting in stabilizing the structure through enhanced durability and stability. In order to achieve the engagement, flat lips formed on one surface of the block are arranged to engage, retain and/or lock the flat notched base surface of an adjoining block within the zone formed within the lips. In this connection, the lips as formed on the block top surface have integral mutually opposed triangular portions extending inwardly defining opposed apices, while the block lower surface is provided with a notched base of trapezoidal configuration for engagement with the lips. The overall trapezoidal configuration of the block facilitates the creation of either straight walls or walls with more tightly curved, arcuate, and/or sinusoidal configurations.

In the past, various block body designs have been proposed which are of generally rectangular configuration. While certain arcuate configurations may be created from stacked arrays of such blocks, the rectangular block configuration is most readily adapted for creation of relatively straight walls, since the right angular arrangement of its surfaces imposes a practical limitation upon the arcuate configurations possible. While trapezoidal blocks have been in use in the past, trapezoidal configurations with interlocking features provide greater stability along with the ability to create shorter arcs.

Interlocks with sharply protruding features such as tongue and groove arrangements have been proposed, with certain of such arrangements facilitating the erection of stable curved walls with shorter arcs. However certain of these tongue and groove blocks have proven difficult to manufacture and arrange for stacked shipment. Moreover, such blocks typically cannot include a hollow core. Blocks fabricated pursuant to the present invention are capable of manufacture utilizing conventional molds and molding techniques.

While the blocks of the present invention have particular application to the erection of retaining walls, the added stability which the structures provide make the blocks well suited for other applications, including those for certain components of the fence structure in U.S. Pat. No. 5,623,797, entitled "BLOCK STRUCTURE AND SYSTEM FOR ARRANGING ABOVE-GROUND FENCING, RAILING AND/OR SOUND BARRIERS" and the structural walls as disclosed in U.S. Pat. No. 6,082,067, entitled "DRY STACKABLE BLOCK STRUCTURES", both of which are assigned to the same assignee as the present invention.

SUMMARY OF THE INVENTION

In accordance with the present invention, a block such as a retaining wall block is created which is arranged to be stacked vertically for creation of a retaining wall, with the improved block comprising and incorporating a lower profile interlock which accommodates and facilitates the erection of permanent, rigid, and stable wall structures. Because of their regular configuration, and lack of any extending, protruding, or other anomalous appendages, the block of the present invention can be manufactured and produced utilizing conventional techniques, and may be fabricated within molds that lie flat, or alternatively in molds wherein the blocks are produced on end. Additionally, central hollow cores may be provided in the block, with the cores being desirable for reducing the quantity of material required in production, and also for reducing the gross weight of the product. The former is a cost reduction feature, the latter being a feature which lightens the load for shipping as well as for those persons who move, stack, or otherwise handle the individual blocks from production to ultimate placement and wall assembly.

The wall blocks of the present invention comprise a block body of generally trapezoidal configuration having a central axis extending between parallelly arranged front and rear surfaces. The body is provided with top and bottom surfaces, and with mutually rearwardly converging lateral side walls. As indicated earlier, the trapezoidal configuration of the block increases its utility by making it possible to readily create rigid and durable straight, curved or sinusoidal walls, with the block bodies being interlocked, one to another, when in stacked relationship as may be required for erection of the retaining wall structure. The top surface of the block body has flat front and rear lips formed thereon, with each of the lips having a root portion of trapezoidal configuration with side walls coextensive with the lateral side walls. Each root portion has an integrally attached mutually opposed triangular portion extending inwardly of the block so as to define opposed aligned front and rear apices. These apices are spaced apart along the central axis of the block.

The bottom surface of the block, being trapezoidal, comprises a central base with opposed notches being formed along the front and rear edges, with the front and rear edges of the base being configured so as to be received within and between the opposed front and rear apices. In the erection of curved walls, it is desirable to provide an unbroken surface for exposed portions of the top surfaces. Accordingly, the lateral dimension of the root portion is sufficiently large so as to fully cover and conceal any void created between the leading edge surfaces of the triangular portions of the lips formed on the lower block surface and the notches formed along the base of the superimposed block.

As indicated above, the configuration of the blocks is such that no unusual or outwardly extending or protruding appendage is present, and furthermore the configuration permits and facilitates production of hollow core blocks. The configuration is further designed to facilitate production with the blocks in either flat or on edge. In addition, core pulling techniques such as disclosed in U.S. Pat. No. 5,484,236, entitled "METHOD OF FORMING CONCRETE RETAINING WALL BLOCK", assigned to the same assignee as the present invention, may be employed in production. The design and arrangement of the block body of the present invention is such that the block can be split to provide textured front and rear surfaces. The configuration further facilitates creation and erection of tightly curved, arcuate and/or sinusoidal retaining walls. While the terms "front surface" and "rear surface" are used throughout, it will be understood that this designation is for purposes of defining the block, without regard to its ultimate disposition in a finished wall structure. In other words, in a finished wall structure, that surface which has been identified as the "rear surface" of the block may well be disposed in and along the front of the finished wall.

Therefore, it is a primary object of the present invention to provide an improved retaining wall block which is specifically designed to be stacked vertically for creation of arcuate, curved, and/or sinusoidal configured retaining walls.

It is a further object of the present invention to provide an improved retaining wall block which is designed to be interlocked when stacked adjacent rows or columns, with the interlock being achieved without requiring protruding or outwardly extending appendages or the like on the block surface.

It is yet a further object of the present invention to provide an improved block body of generally trapezoidal configuration and which is provided with interlocking features including upper lips and lower base features which are in engagement, one with the other.

Other and further objects of the present invention will become apparent to those skilled in the art upon a study of the following specification, appended claims, and accompanying drawings.

IN THE DRAWINGS

DESCRIPTION OF THE PREFERRED EMBODIMENT

Figure 1:
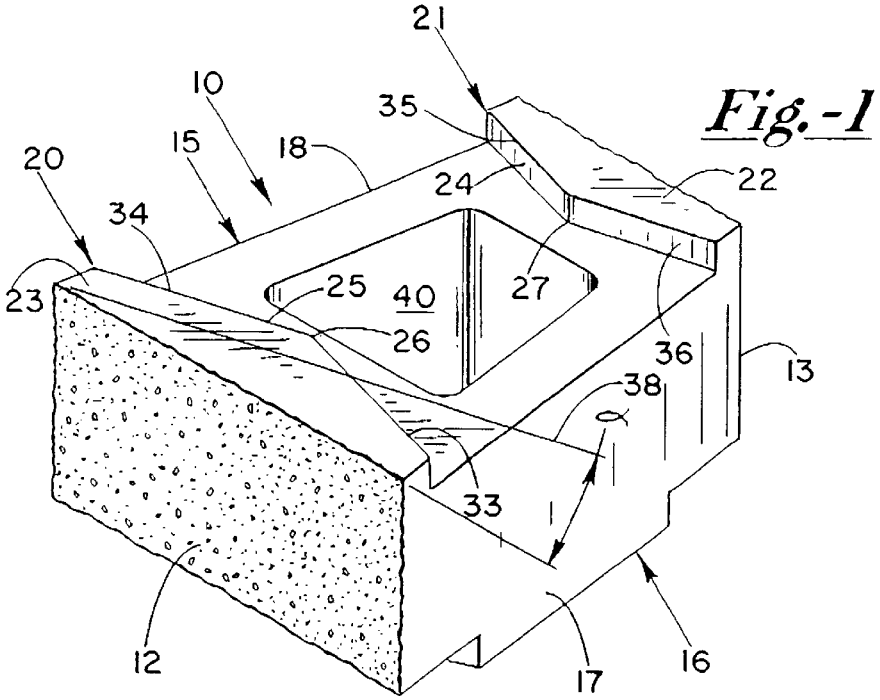
FIG. 1 is a front perspective view of a block body prepared in accordance with the present invention, and illustrating the detail of the configuration of the upper lips, and the general arrangement of the lower base.
Figure 2:
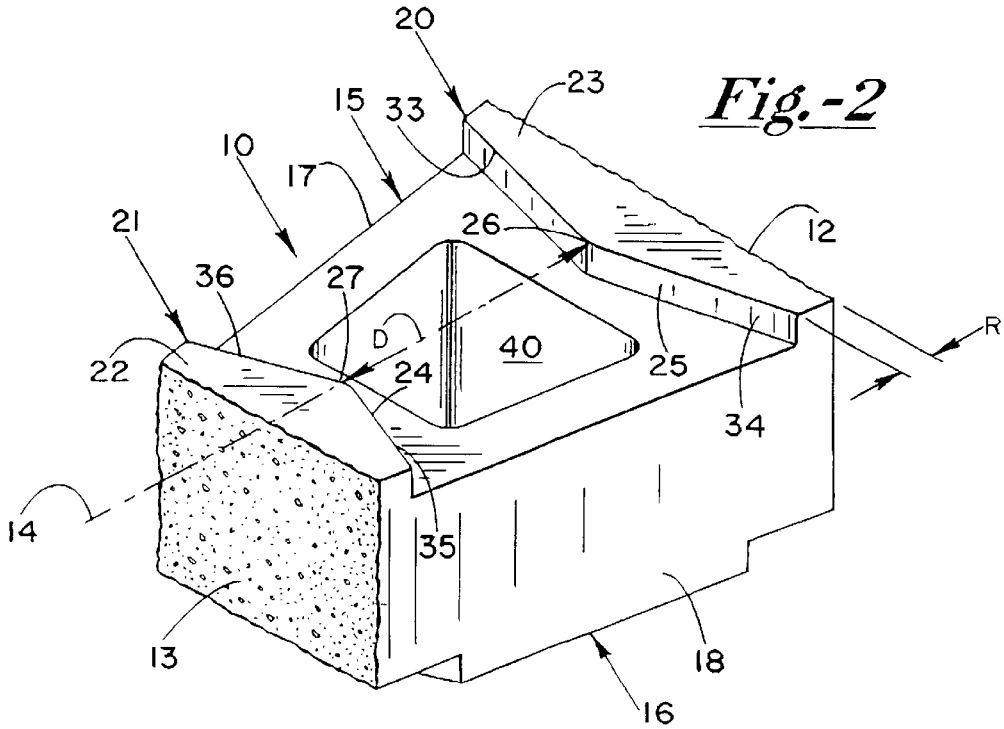
FIG. 2 is a rear perspective view similar to FIG. 1, and further illustrating the detail of the interlocking lips and base.

In accordance with the preferred embodiment of the present invention, and with particular attention being directed to FIGS. 1 and 2 of the drawings, the block body generally designated 10 is of generally trapezoidal configuration having a central axis extending between the parallelly arranged front and rear surfaces 12 and 13 respectively. As indicated, the block body has an axis extending generally along line 14. Also, as indicated, both front surface 12 and rear surface 13 are textured, having been formed by appropriate block breaking or splitting operations.

Block 10 is further provided with top surface generally designated 15 and a bottom surface generally designated 16. Top surface 15 and bottom surface 16 are, of course, parallelly disposed as are front and rear surfaces 12 and 13. Block 10 further includes mutually rearwardly converging lateral side walls as at 17 and 18, with these walls generally being formed with a smooth surface. The top surface of block 10 has mutually opposed front and rear lip portions as shown generally at 20 and 21 respectively. Lip portions 20 and 21 comprise root portions 22 and 23 along with mutually opposed triangular portions 24 and 25 respectively. The triangular portions define opposed aligned front and rear apices 26 and 27, with the apices being aligned with central axis 14. Apices 26 and 27 are spaced apart by a dimension "D", as illustrated in FIG. 2.

Figure 2A:
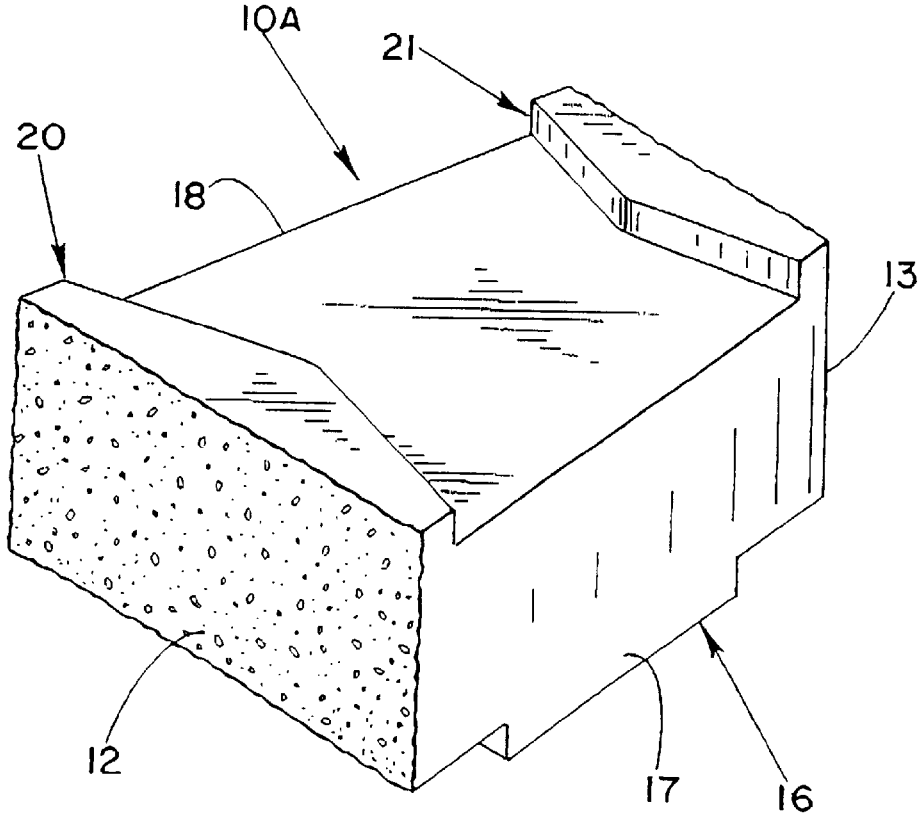
FIG. 2A is a front perspective view of a block body similar to that illustrated in FIGS. 1 and 2, and illustrating the detail of such a block structure with a solid body.

With attention now being directed to FIG. 2A of the drawings, the block generally designated 10A is identical in all respects to that shown in FIG. 1, with the exception of the lack of a hollow core such as core 40 illustrated in FIG. 1. Accordingly, it will be appreciated that block 10A has the same configurational features as block 10 of FIGS. 1 and 2, with the sole exception of the substitution of a solid body for the hollow core structure present in the device illustrated in FIGS. 1 and 2.

Figure 3:
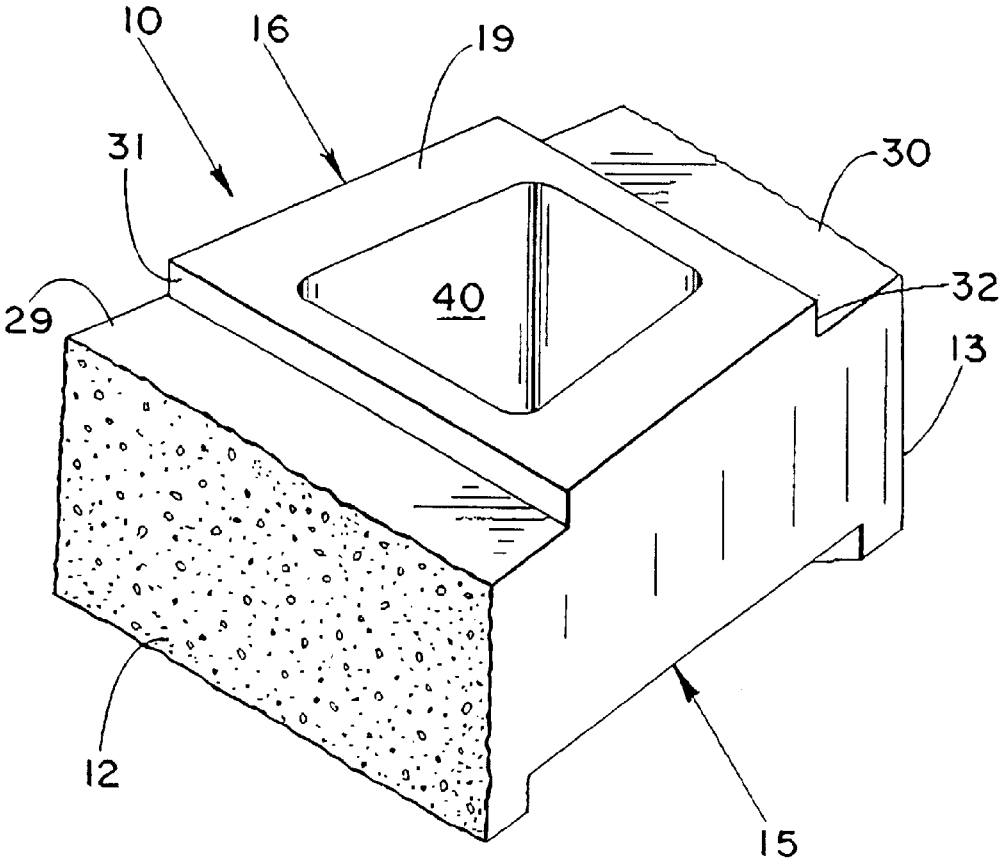
FIG. 3 is a front perspective view of the block of FIGS. 1 and 2, showing the front and base surfaces along with the side wall, with FIG. 3 further illustrating the configuration of the generally trapezoidal base.

With attention being directed to FIG. 3 of the drawings, the bottom surface 16 of the block 10 comprises a rectangular central base 19 with opposed notches 29 and 30 formed therein. Accordingly, as shown in FIG. 3, the base 19 is of trapezoidal configuration with oppositely disposed edge surfaces as at 31 and 32. Oppositely disposed front and rear edges 31 and 32 are spaced apart by a distance which does not exceed the dimension "D" separating front and rear apices 26 and 27 on the opposed or top surface 15.

Integral triangular portions on each of the lips, as at 24 and 25 each include leading edges as at 33, 34, 35 and 36. These leading edge surfaces intersect to form the opposed front and rear apices 26 and 27 respectively.

The root portions of each of the lips has a lateral depth dimension as shown at "R" (FIG. 2). Lateral depth dimension "R" is delineated by the plane which lies along a first lateral wall such as lateral wall 17 and which is included in the gap created between the plane of the front surface 12 and an oblique plane as at 38 (FIG. 1) which lies generally parallel to the plane of the first leading lip edge 34 and extends between the edge of front surface 12 and the intersection between the edge surface of second leading lip 33 and the lateral side wall 17.

Figure 4:
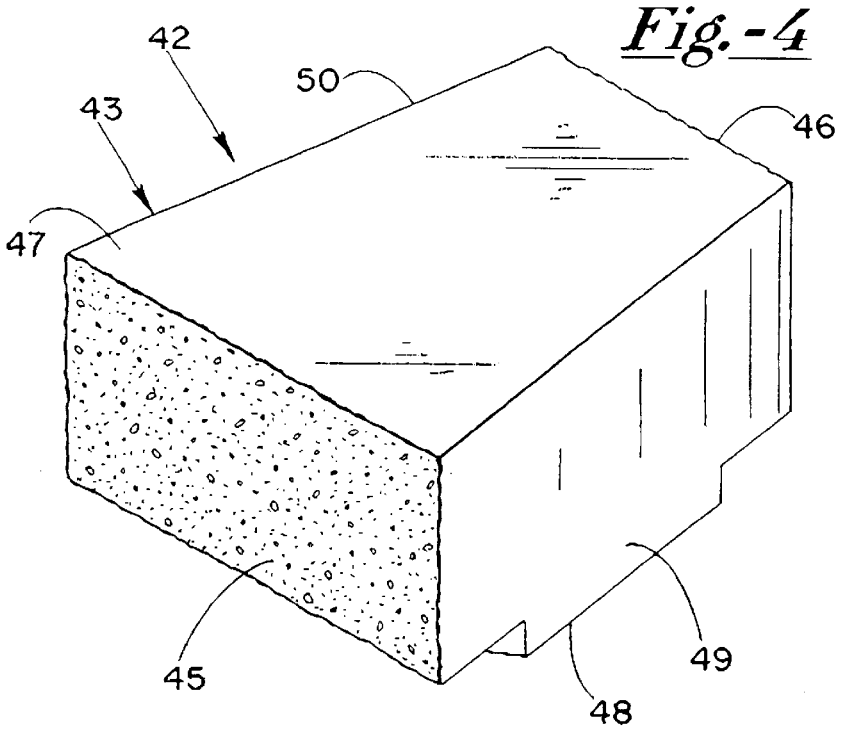
FIGS. 4 and 5 are front and rear perspective views, respectively, of a cap block used in combination with the block bodies of FIGS. 1–3 inclusive.
Figure 5:
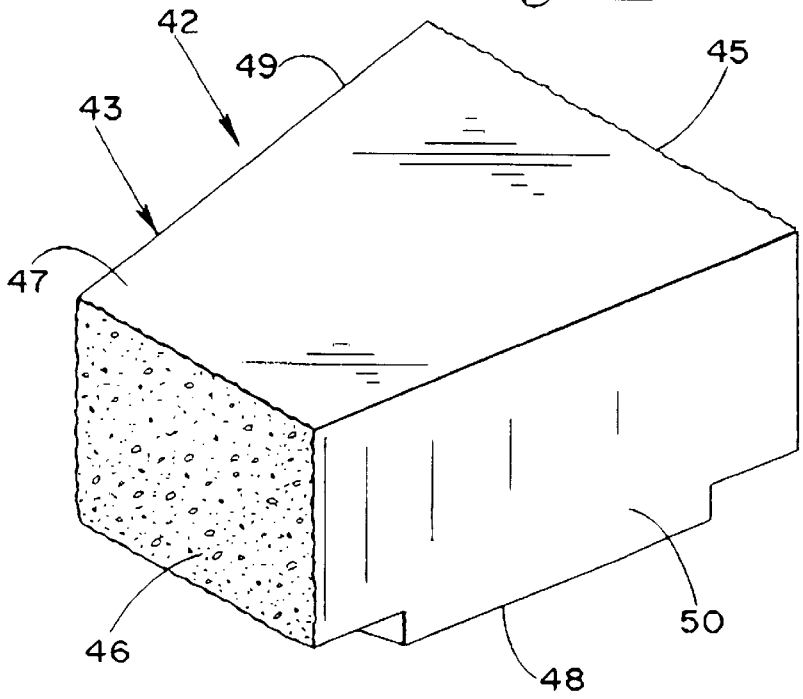
Figure 6:
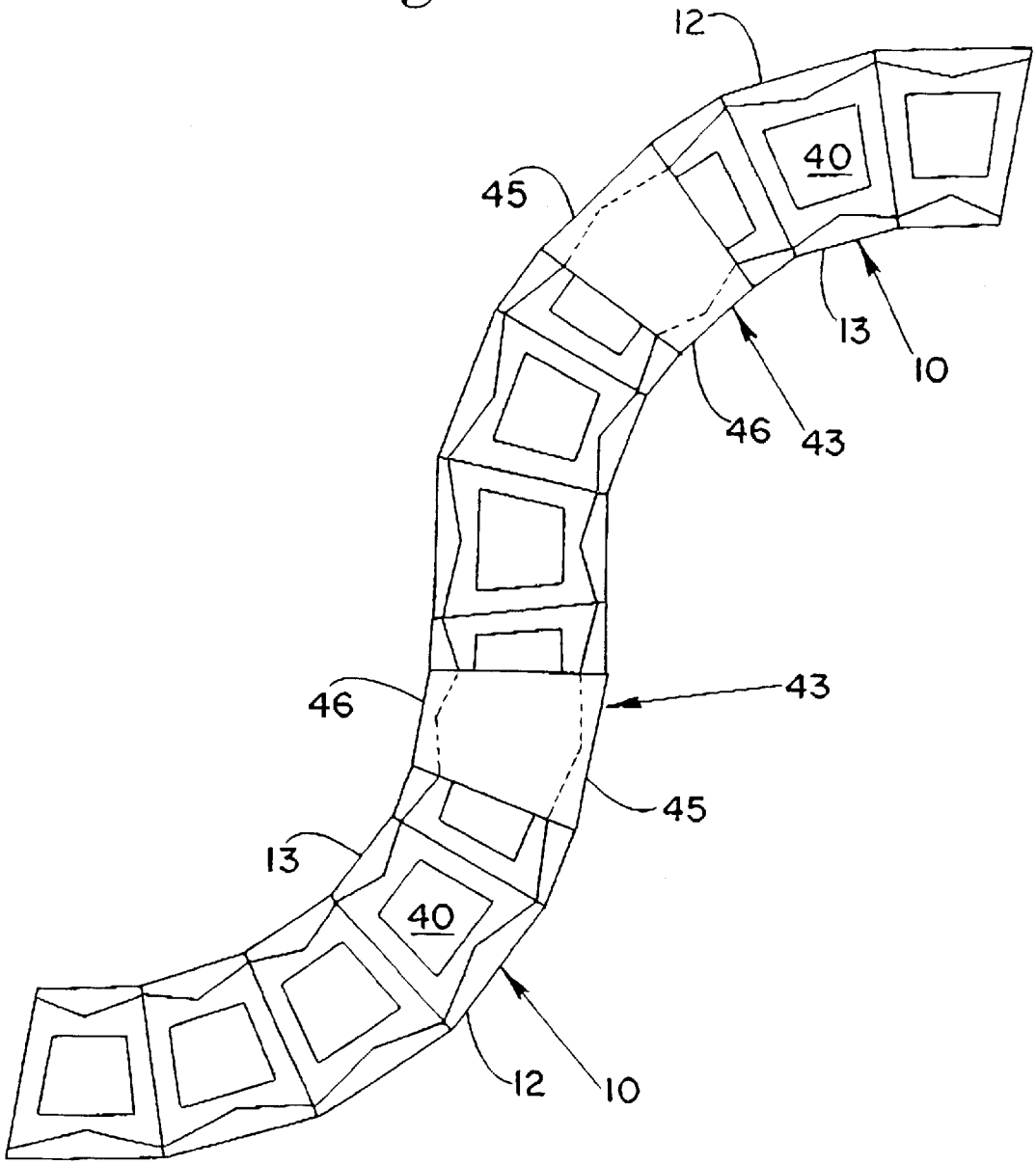
FIG. 6 is a top plan view of a retaining wall in sinusoidal configuration utilizing the block of the present invention.

FIGS. 4 and 5 illustrate a cap block structure which is well adapted for use in connection with the present invention. Cap block generally designated 42 comprises a cap block body 43 of trapezoidal configuration, matching that of block body 10. The trapezoidal cap block has parallelly arranged front and rear surfaces 45 and 46 respectively along with top 47 and base 48. Lateral side walls such as at 49 and 50 are also disclosed. Front surface 45 and rear surface 46 are, of course, textured so as to be consistent with the structure of the structural block bodies. While base surface 48 is generally trapezoidal, and substantially identical to that of base 19, top surface 43 is, of course, totally planar in order to achieve the desired aesthetic appearance.

Figure 7:
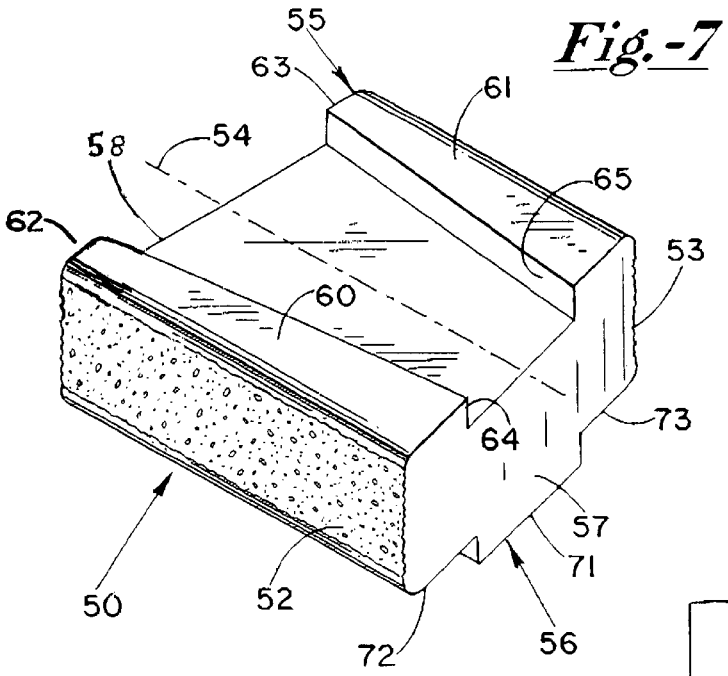
FIG. 7 is a front perspective view of an alternate embodiment of the block of the present invention and illustrating the detail of the configuration of the upper lips along with the general arrangement of the lower base.
Figure 8:
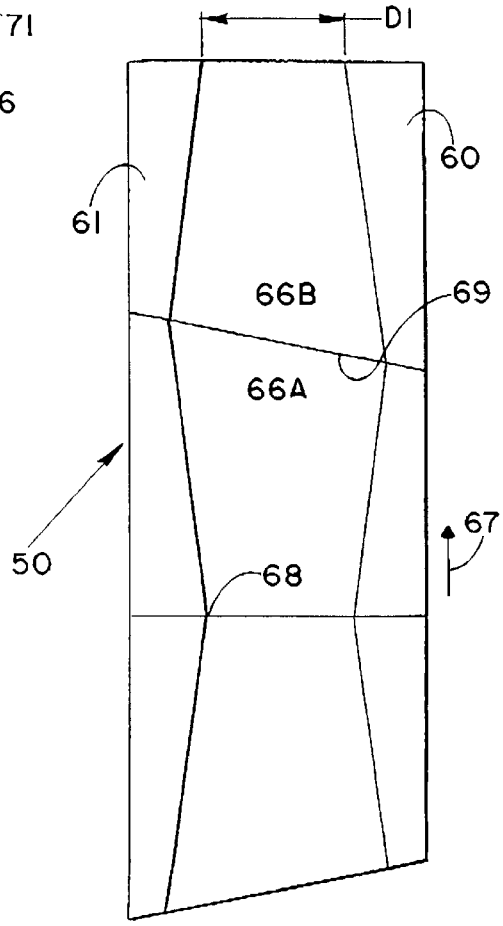
FIG. 8 is a top plan view of the alternate embodiment illustrated in FIG. 7, and with the blocks being arranged in general alignment.

In accordance with the alternative embodiment as illustrated in FIGS. 7 and 8, block body generally designated 50 is of generally trapezoidal configuration having a central axis extending between parallelly arranged front and rear surfaces 52 and 53 respectively. As indicated, block body 50 has an axis extending generally along line 54. Also, as indicated in the view of FIG. 7, both front surface 52 and rear surface 53 are textured, having been formed by appropriate block splitting operations similar to that discussed in connection with the embodiment of FIGS. 1–6.

Block 50 is provided with a top surface generally designated 55 and a bottom surface generally designated 56. Top surface 55 and bottom surface 56 are, of course, parallelly disposed as are front and rear surfaces 52 and 53. Block 50 further includes mutually rearwardly converging lateral side walls as at 57 and 58, with these walls having a smooth surface. The top surface of block 50 has mutually opposed front and rear lip portions 60 and 61 respectively. Lip portions 60 and 61 are each configured as truncated triangular members each with a root or base portion as at 62 and 63, along with mutually converging face portions as at 64 and 65. The truncated triangular portions are designed to mate with similarly configured truncated portions of adjacently positioned blocks, so that a matched pair of blocks, taken together, will define a mutually diverging zone adjacent the mutually converging zone, when viewed in the direction of arrow 67. This feature is illustrated in greater detail in FIG. 8, with one mutually diverging zone being shown at 66A, and the mating mutually converging zone being shown at 66B. Thus, each matched pair of blocks will define triangular portions defining opposed aligned front and rear apices as at 68, along with an inflection zone as at 69. Each of these apices is, of course, aligned with central axis 54 of block 50. Also, apices as at 68 are spaced apart by dimension "$D_1$" as illustrated in FIG. 8. As illustrated in FIG. 8, the trapezoidal configuration of block 50 includes the front and ear surfaces 52 and 53 along with end faces such as face 74 which is arranged in right angular relationship to front and rear faces 52 and 53. Other angular relationships may, of course, be employed if desired. For most purposes, however, the matched pair of blocks will utilize similar angular configurations for each of its faces as well as a similar size.

In order to appropriately mate superimposed blocks and form the interlock function, bottom surface 56 comprises a rectangular central base as at 71 defined or delineated by opposed notches formed as at 72 and 73. Central base 71 is arranged coaxially with axis 54, with the width dimension (front side to rear side) being no greater than the dimension of apex "$D_1$". In this fashion, therefore, the interlock function is achieved without otherwise interfering with the proper stacking capability of the block.

As indicated above, blocks 10 and 50 may be readily fabricated with a core as at 40 (FIG. 1), and furthermore the configurations accommodate production techniques which expedite fabrication and manufacturing productivity inasmuch as the configurations provide for the formation of stacking assemblies formed by a combination of two blocks instead of a singular block structure. For example, the block configuration in FIGS. 1–6 accommodate production on both a flat and on-end basis, with the structure of FIGS. 7 and 8 accommodating production on a side surface. These configurations therefore contribute to a substantial increase in manufacturing productivity. The interlocking trapezoidal configuration readily facilitates the creation of tightly curved, arcuate and sinusoidal retaining walls which are rugged, firm and stable, with the stability having been enhanced due to the interlocking capability. Alternatively, the block may be fabricated without the core as illustrated in FIG. 2A.

It will be appreciated that various modified forms of construction blocks may be prepared utilizing the techniques of the present invention, it being further understood that the examples given herein are for purposes of illustration only and are not to be construed as a limitation upon the scope to which the invention is otherwise entitled.

What is claimed is:

1. A wall block arranged to be stacked vertically for creation of a retaining wall, said retaining wall block comprising:

(a) a block body of generally trapezoidal configuration having a central axis extending between parallelly arranged front and rear surfaces, and having top and bottom surfaces and with mutually rearwardly converging lateral side walls;

(b) said top surface having front and rear lips formed thereon with each of said lips having a root portion of trapezoidal configuration with mutually opposed triangular portions extending inwardly therefrom and defining opposed aligned front and rear apices, said opposed apices being spaced apart along said central axis by a first predetermined dimension;

(c) said bottom surface comprising a central base with opposed notches formed along the front and rear edges thereof, said base having a trapezoidal configuration with oppositely disposed front and rear edges spaced apart by a distance which does not exceed said first predetermined dimension;

(d) said triangular portions of each of said lips comprising first and second opposed leading edge surfaces intersecting to form said opposed front and rear apices; and (e) the root portions of each of said lips having a lateral depth dimension which is delineated by that plane which lies along a first of said lateral walls and which is included in the gap created between the plane of said block body front surface and an oblique plane which lies generally parallel to the plane of said first leading lip edge and which extends between a first edge of said front surface and the intersection of said second leading lip edge with said first lateral side wall.

2. The wall block of claim 1 further comprising a block body with a central hollow core extending between said top and bottom surfaces.

3. The wall block of claim 1 wherein said mutually opposed triangular portions are integral with said root portions.

4. A wall block structure arranged to be stacked vertically in a matched pair relationship of first and second block units for creation of a retaining wall, said retaining wall block comprising:

(a) a block body of generally trapezoidal configuration having a central axis extending between parallelly arranged front and rear surfaces, and having top and bottom surfaces and with mutually rearwardly converging lateral side walls;

(b) said top surface having front and rear lips formed thereon with each of said lips having a root portion of trapezoidal configuration with mutually opposed triangular portions extending inwardly therefrom and defining opposed aligned mutually converging linear edge surfaces, front and rear apices, said opposed edge surfaces being spaced apart along said central axis by a first predetermined dimension;

c) said bottom surface comprising a central base with opposed notches formed along the front and rear edges thereof, said base having a trapezoidal configuration with an axis which lies along the plane of said central axis and having oppositely disposed front and rear edges spaced apart by a distance which does not exceed said first predetermined dimension; and (d) said mutually converging linear edge surfaces of each of said lips on the first block unit of each matched pair of blocks intersecting with mutually diverging linear edge surfaces of each of said lips on the second block unit of each matched pair of blocks to form opposed front and rear apices.

* * * * *